US006648345B2

(12) United States Patent
Lee

(10) Patent No.: US 6,648,345 B2
(45) Date of Patent: Nov. 18, 2003

(54) ANTI-WEAR STRIP EQUIPPED WHEEL SEAT OF SKATEBOARD

(76) Inventor: Chien-Hua Lee, 9F, No. 52, Peng-Lai Rd., Wu-Ku Country, Taipei Hsien (TW)

( * ) Notice: Subject to any disclaimer, the term of this patent is extended or adjusted under 35 U.S.C. 154(b) by 0 days.

(21) Appl. No.: 10/104,831

(22) Filed: Mar. 22, 2002

(65) Prior Publication Data

US 2003/0178804 A1 Sep. 25, 2003

(51) Int. Cl.[7] ..... A63C 3/00

(52) U.S. Cl. ..... 280/11.27; 280/809; 280/87.042; 280/11.28

(58) Field of Search ..... 280/87.042, 11.27, 280/11.28, 809, 811, 157, 11.19, 87.021, 87.041, 87.03

(56) References Cited

U.S. PATENT DOCUMENTS 4,214,768 A * 7/1980 Dominy et al. ..... 280/809
4,515,379 A * 5/1985 Pasques ..... 280/11.27
5,879,013 A * 3/1999 Shih ..... 280/11.28
6,056,302 A * 5/2000 Smith ..... 280/87.042
6,105,978 A * 8/2000 Vuerchoz ..... 280/11.27
6,443,471 B1 * 9/2002 Mullen ..... 280/87.042
2002/0153685 A1 * 10/2002 Day et al. ..... 280/87.042

* cited by examiner

*Primary Examiner*—Brian L. Johnson
*Assistant Examiner*—J. Allen Shriver

(57) ABSTRACT

An anti-wear strip equipped wheel seat comprises a main body, an axle, and an anti-wear strip, in which the anti-wear strip is a U-shaped plate made of a wear-resist material, having an arcuate recess in each of two end edges thereof for mounting the axle directly. The axle and the anti-wear strip are embedded stably in the main body except an anti-wear face at the bottom edge of the anti-wear strip and both ends of the axle so that the bottom edge of the wheel seat is protected against wearing, particularly for a technical trick performance or race.

4 Claims, 6 Drawing Sheets

ANTI-WEAR STRIP EQUIPPED WHEEL SEAT OF SKATEBOARD

FIELD OF THE INVENTION

The present invention generally relates to a strip for a wheel seat, and more specifically to an anti-wear strip equipped wheel seat.

BACKGROUND OF THE INVENTION

A skateboarding veteran in these days is expected to play some peculiar tricks other than the routines. Tricks such as skating with the wheel seat of a skateboard along a transverse rail result in a ruptured or worn-out wheel seat sooner or later. Thus, the wheel seat has to be replaced from time to time in order to avoid possible dangers. However, most of the skateboard makers have not considered this problem in manufacturing the skateboard. There is a need in providing improvement to the skateboard so as to increase its lifetime.

SUMMARY OF THE INVENTION

The primary objective of this invention is to provide an anti-wear strip equipped wheel seat comprising: a main body, an, and an anti-wear strip, in which the anti-wear strip is a U-shaped plate made of a wear-resist material, having an arcuate recess in each of two end edges thereof for mounting the axle directly. The axle and the anti-wear strip are embedded stably in the main body except an anti-wear face at the bottom edge of the anti-wear strip and both ends of the axle so that the bottom edge of wheel seat could be protected against wearing, particularly for a technical trick performance or race.

In short, the merits of this invention might be summarized in the following:

(1) The lifetime or sightliness of a wheel scat is prolonged or promoted by using this invention.

(2) The anti-wear strip is stably fixed in the main body by taking, advantage of the arcuate recess at both ends of the anti-wear strip for avoiding its detachment by an external impact.

(3) The axle can be loaded easily during the fabrication process and the molding cost and complicatedness might be lowered or simplified with the favorable arcuate recesses.

For more detailed information regarding advantages or features of this invention, at least an example of preferred embodiment will be fully described below with reference to the annexed drawings.

BRIEF DESCRIPTION OF THE DRAWINGS

The related drawings in connection with the detailed description of this invention to be made later are described briefly as follows, in which.

DETAILED DESCRIPTION OF THE INVENTION

Figure 1:
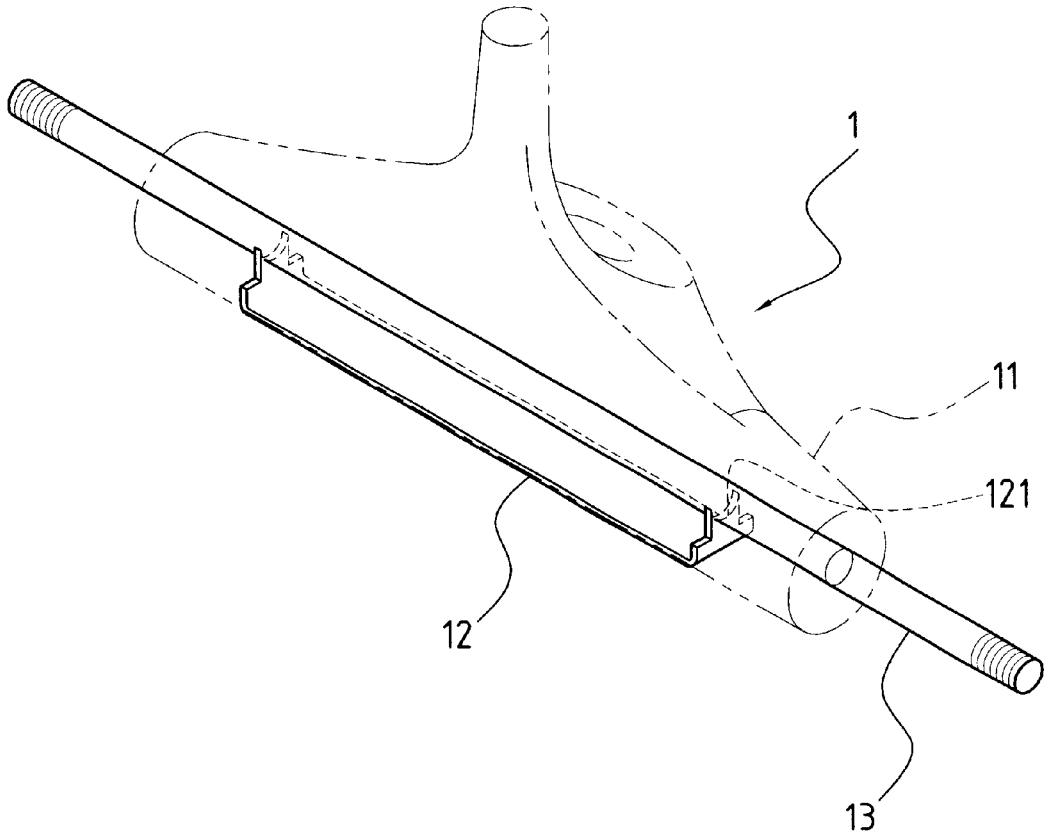
FIG. 1 is a schematic perspective view of this invention.
Figure 2:
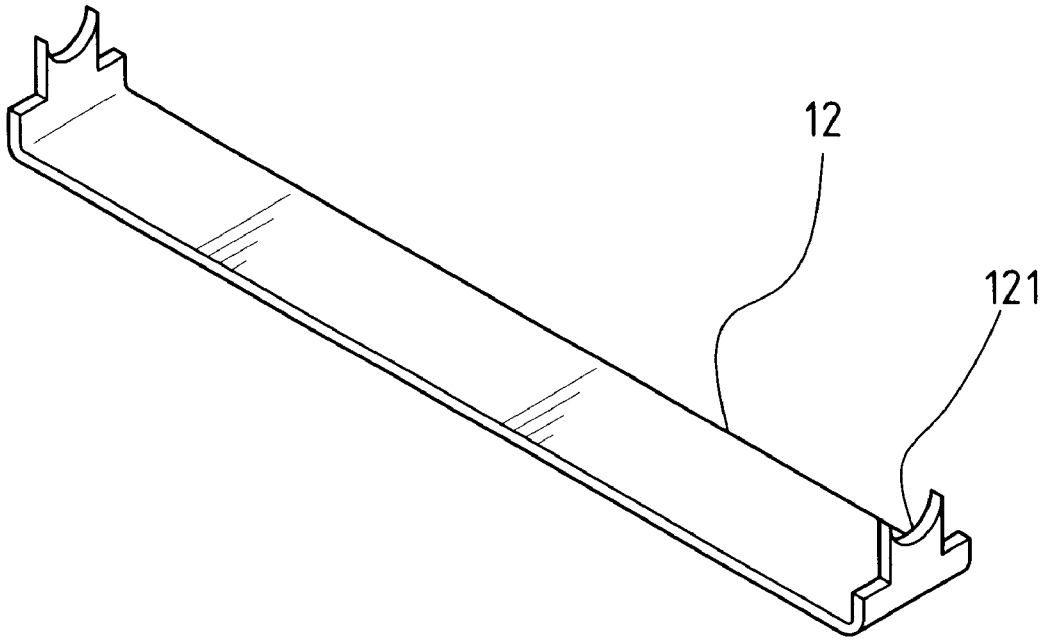
FIG. 2 is a schematic view of this,invention in three dimensions.

As illustrated in FIGS. 1 and 2, a wheel seat (1) of skateboard is composed of a main body (11), an axle (13), and an anti-wear strip (12). Both ends of the anti-wear strip is bent upwardly to form a U-shaped longitudinal plate made of a wear-resist material, having an arcuate recess (121) in each of two end edges thereof matched in curvature with the outer diameter of the axle (13) so that the axle (13) can lie directly on those arcuate recesses (121) fitly. The axle (13) and the anti-wear strip (12) are then embedded in the main body (11) except an anti-wear face (122) at the bottom edge of the anti-wear strip (12) and two ends of the axle (13).

In the formation of the entire wheel seat (1), the procedure is to fix the anti-wear strip (12) in a mold firstly; then lay the axle (13) on the top edge of the anti-wear strip (12); and cast it in a liquefied metallic material to form the main body (11) and have the axle (13) and the anti-wear strip embedded therein. By taking advantage of the arcuate recess (121) designed in the anti-wear strip (12) for the axle (13) to stride, in addition to reducing the molding cost, it is possible to have the anti-wear strip (12) and the main body (11) consolidated together to avoid the detachment of the anti-wear strip (12) by an external powerful impact. Moreover, the bottom edge of the wheel seat (1) is prevented from getting worn-out when rubbing against earth or rails in a race or performance so that the lifetime or sightliness thereof can be prolonged or maintained.

Figure 3:
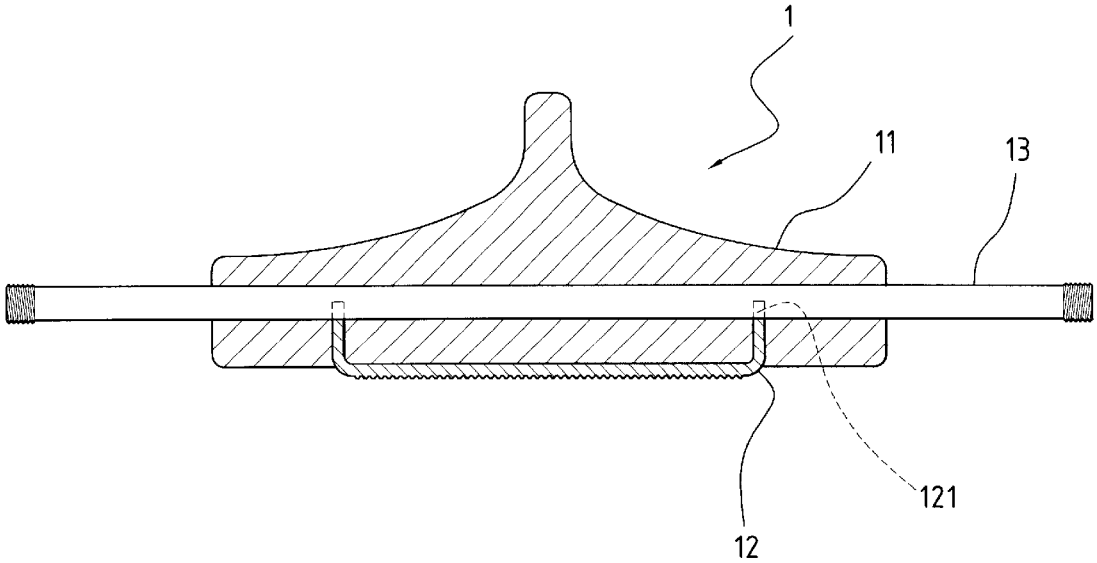
FIG. 3 is a cutaway sectional view showing the assembly of a wheel seat of this invention.
Figure 4:
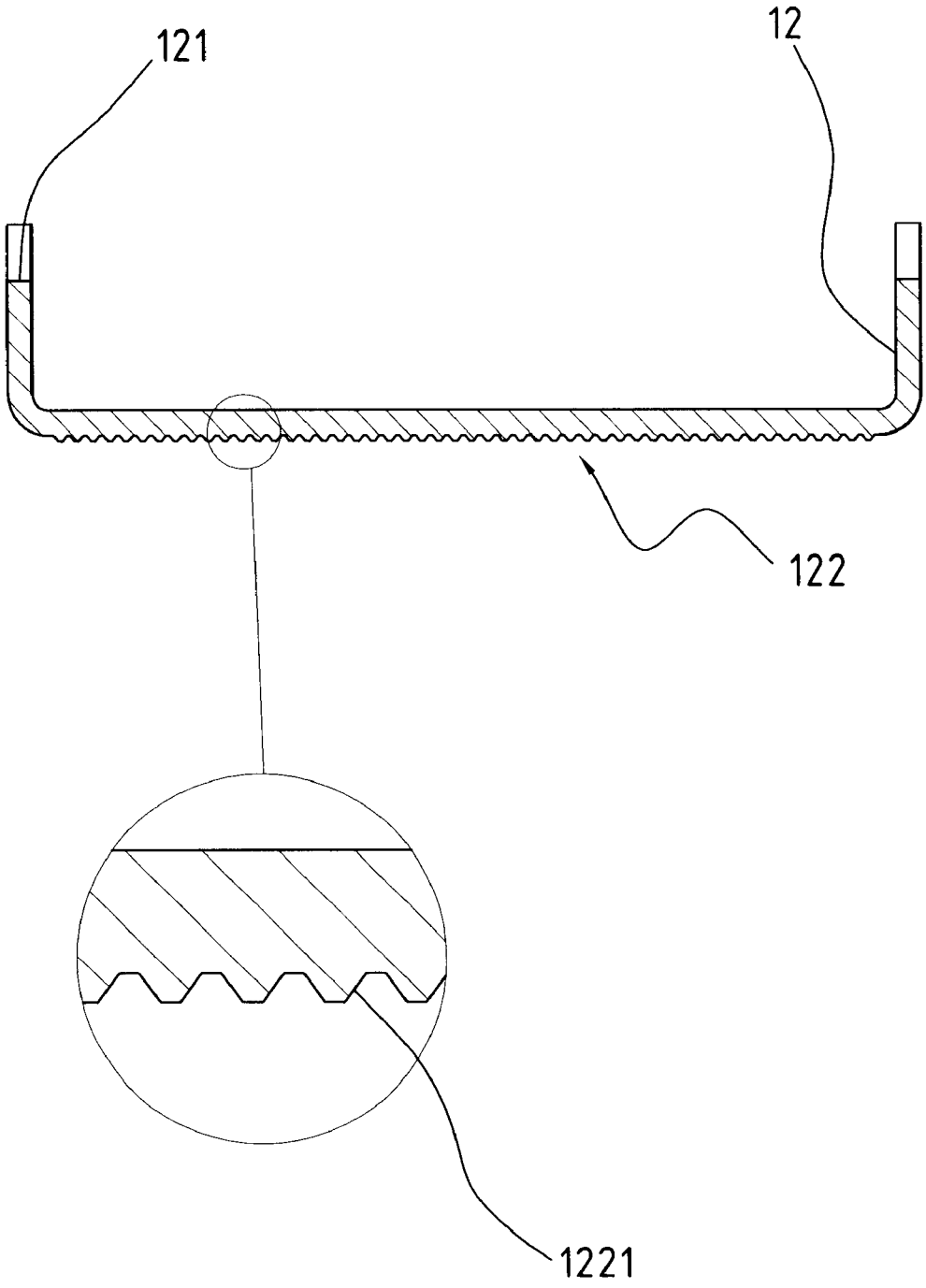
FIG. 4 is a cutaway sectional view showing an anti-wear strip of this invention.

Referring to FIGS. 3 and 4, both ends of the anti-wear strip (12) is bent upwardly to form a U-shaped longitudinal plate made of a wear-resist material, having an arcuate recess (121) in each of two end edges thereof so as to accommodate and support an axle (13) directly. The bottom edge of the anti-wear strip (12) is substantially an anti-wear face (122) protruded from a main body (11) about 1 mm thick after the anti-wear strip (12) is embedded in the main body (11). Furthermore, a plurality of slip-resist lumps (1221) shaped in cones, spheres, or pillars could be formed on the anti-wear face (122).

Figure 5:
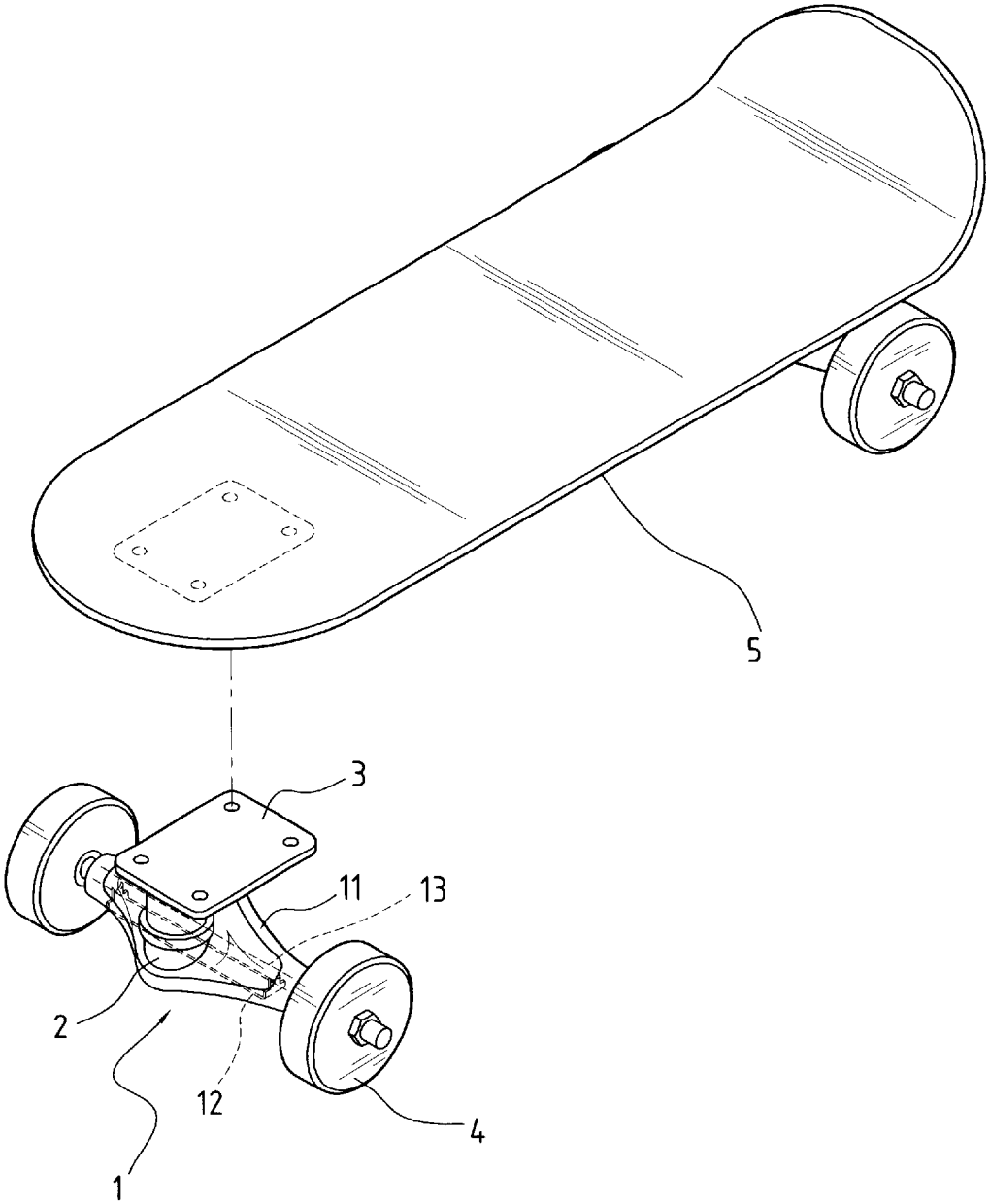
FIG. 5 is a schematic view showing an embodiment (A) of this invention.
Figure 6:
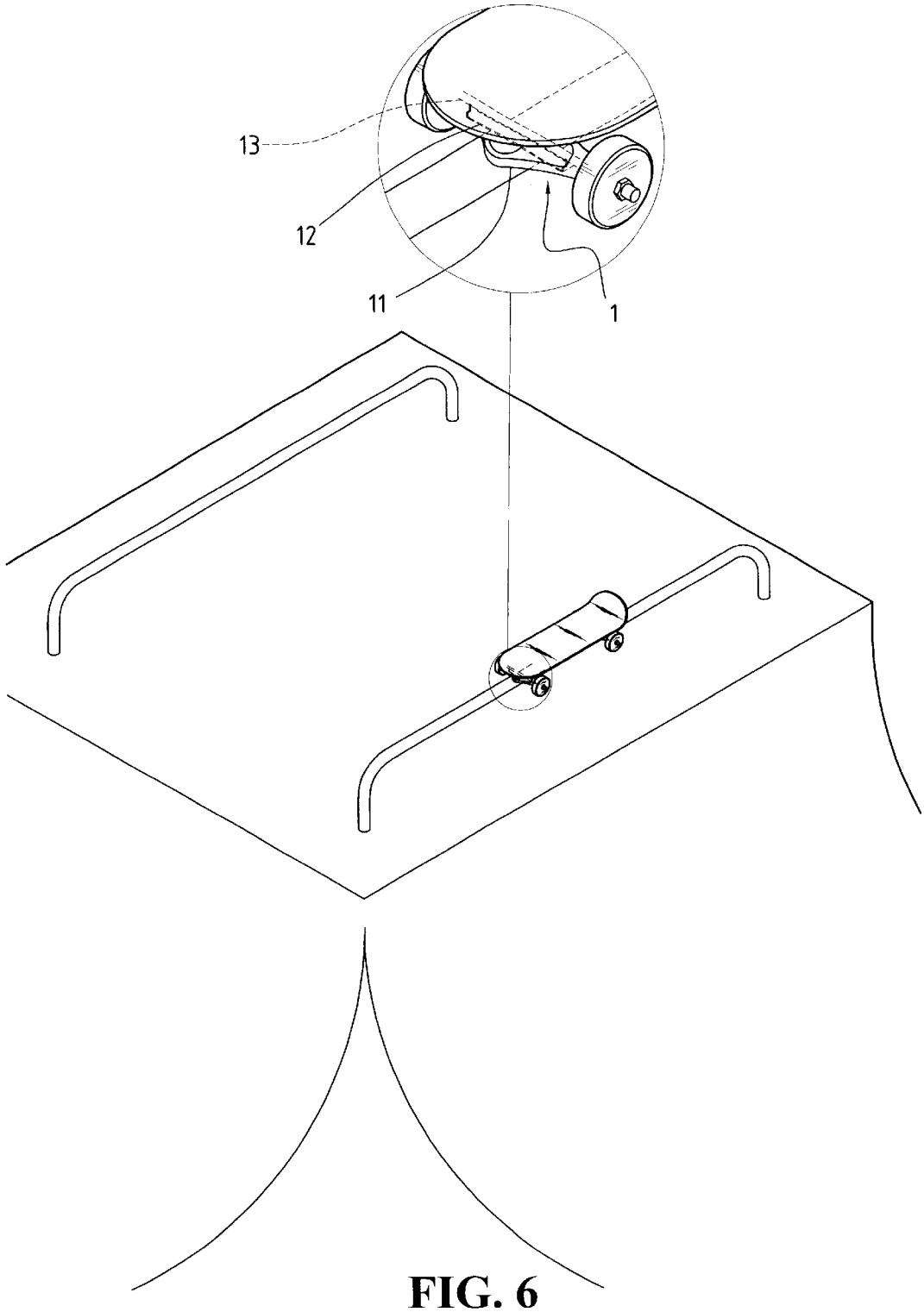
FIG. 6 is a schematic view showing another embodiment (B) of this invention.

As indicated in embodiment (A) and (B) of FIGS. 5 and 6, the wheel seat (1) is composed of a main body (11), an axle (13), and an anti wear strip (12). A wheel (4) is mounted on respective ends of the axle (13) protruding laterally over the main body (11) and a shock absorber (2) and a securing top plate (3) are disposed at a front edge and a top edge respectively of the main body (11) to thereby fix the wheel seat (1) to a skate board (5).

The anti-wear strip of this invention is particularly effective for preventing the wheel seat from being worn out when it is used as a narrow skateboard for skating along a handrail of staircase transversely.

In the above described, at least one preferred embodiment has been described in detail with reference to the drawings annexed, and it is apparent that numerous variations or modifications may be made without departing from the true spirit and scope thereof, as set forth in the claims below.

What is claimed is:

1. An anti-wear strip equipped wheel seat of a skateboard, comprising:

a main body;

a U-shaped anti-wear strip having an anti-wear bottom face and two ends, said anti-wear strip being made of a wear-resist material, and each of said two ends being formed with an arcuate recess, and an axle supported by said arcuate recess, said axle being embedded in said main body with two axle ends extended outside said main body;

wherein said anti-wear strip and said two ends of said anti-wear strip including said two arcuate recesses are embedded in said main body with said anti-wear bottom face being exposed outside said main body.

2. The anti-wear strip equipped wheel seat of a skateboard as claimed in claim 1, wherein said anti-wear bottom face protrudes outwardly out of said main body by about 1 mm thick.

3. The anti-wear strip equipped wheel seat of a skateboard as claimed in claim 1, wherein said anti-wear bottom face is formed with a plurality of slip-resist lamps.

4. The anti-wear strip equipped wheel seat of a skateboard as claimed in claim 3, wherein said plurality of slip-resist lumps are made with shapes of cones, spheres or pillars.

* * * * *